US010836167B2

(12) United States Patent
Dodd

(10) Patent No.: US 10,836,167 B2
(45) Date of Patent: Nov. 17, 2020

(54) MICROFLUIDIC DIE ON A SUPPORT WITH AT LEAST ONE OTHER DIE

(71) Applicant: STMICROELECTRONICS, INC., Coppell, TX (US)

(72) Inventor: Simon Dodd, West Linn, OR (US)

(73) Assignee: STMICROELECTRONICS, INC., Coppell, TX (US)

( * ) Notice: Subject to any disclaimer, the term of this patent is extended or adjusted under 35 U.S.C. 154(b) by 0 days.

(21) Appl. No.: 16/179,808

(22) Filed: Nov. 2, 2018

(65) Prior Publication Data

US 2019/0070852 A1 Mar. 7, 2019

Related U.S. Application Data

(63) Continuation of application No. 15/253,618, filed on Aug. 31, 2016, now Pat. No. 10,118,391.

(60) Provisional application No. 62/273,260, filed on Dec. 30, 2015.

(51) Int. Cl.
*B41J 2/14* (2006.01)
*B41J 2/175* (2006.01)

(52) U.S. Cl.
CPC ..... *B41J 2/1433* (2013.01); *B41J 2/14072* (2013.01); *B41J 2/14201* (2013.01); *B41J 2/1753* (2013.01); *B41J 2/17553* (2013.01); *B41J 2002/14362* (2013.01); *B41J 2002/14491* (2013.01)

(58) Field of Classification Search
CPC .... B41J 2/1433; B41J 2/17553; B41J 2/1753; B41J 2/14201; B41J 2/14072; B41J 2002/14362; B41J 2002/14491
See application file for complete search history.

(56) References Cited

U.S. PATENT DOCUMENTS

| | | | | |
|---|---|---|---|---|
| 7,149,090 | B2 | 12/2006 | Suzuki et al. | |
| 2004/0183859 | A1* | 9/2004 | Ito | B41J 2/14209 347/50 |
| 2007/0182787 | A1 | 8/2007 | Kubo et al. | |
| 2008/0316255 | A1 | 12/2008 | Kubo et al. | |
| 2011/0254898 | A1 | 10/2011 | Muraoka et al. | |
| 2012/0113192 | A1* | 5/2012 | Kimura | B41J 2/1753 347/54 |
| 2015/0130873 | A1* | 5/2015 | Kodoi | B41J 2/1433 347/50 |
| 2015/0373840 | A1 | 12/2015 | Dodd et al. | |
| 2017/0080715 | A1 | 3/2017 | Chen et al. | |

* cited by examiner

*Primary Examiner* — Bradley W Thies
(74) *Attorney, Agent, or Firm* — Seed IP Law Group LLP

(57) ABSTRACT

The present disclosure provides supports for a microfluidic die and one or more additional die including, but not limited to, microfluidic die, ASICs, MEMS devices, and sensors. This includes semi-flexible supports that allow a microfluidic die to be at a 90 degree angle with respect to another die and rigid supports that allow a microfluidic and another die to be in close proximity to each other.

18 Claims, 9 Drawing Sheets

MICROFLUIDIC DIE ON A SUPPORT WITH AT LEAST ONE OTHER DIE

BACKGROUND

Technical Field

The present disclosure is directed to a microfluidic die on a support with at least one other die.

Description of the Related Art

Microfluidic die are being used in more and more diverse environments, different from the traditional use as a thermal inkjet die. In the more traditional uses, the inkjet die were typically mounted on a support by themselves. This was because the inkjet die were discarded, such as with the cartridge of ink when the ink had been used, while a relevant processor or application specific integrated circuit (ASIC) remained part of a printer. The ASICs and processors are more expensive to make and thus are not part of the disposable cartridges.

BRIEF SUMMARY

The present disclosure is directed to a variety of supports that provide a low cost solution to replace supports and flexible interconnects of traditional thermal inkjet systems and allow for inclusion of more than one die on a support. Each of the supports are configured to support a microfluidic die and one or more additional die including, but not limited to, other microfluidic die, ASICs, microelectromechanical systems (MEMS) devices, and sensors. The variety of supports includes semi-flexible supports that allow a microfluidic die to be at a 90 degree or other angle with respect to another die, and rigid supports that allow a microfluidic and another die to be in close proximity to each other.

According to one embodiment, a semi-flexible support includes a first rigid portion, a flexible portion, and a second rigid portion. The first rigid portion is separated from the second rigid portion by the flexible portion. The flexible portion may be fabricated by milling or thinning a specific portion of the semi-flexible support. By thinning the flexible portion, the semi-flexible support may be bent up to and beyond 90 degrees. A microfluidic die is positioned on the first rigid portion, and a second die, such as another microfluidic die, an ASIC, a MEMS device, or a sensor, and electrical contacts are positioned on the second rigid portion.

According to another embodiment, the semi-flexible support is cross or "t" shaped and includes a first rigid portion, a second rigid portion, a third rigid portion, a fourth rigid portion, and a flexible portion. The first, second, third, and fourth rigid portions are separated from each other by the flexible portion. The flexible portion allows the semi-flexible support to have up to four different bends up to and beyond 90 degrees. In one embodiment, a microfluidic die is positioned on each of the first rigid portion, the second rigid portion, the third rigid portion, the fourth rigid portion, and the flexible portion.

According to one embodiment, a rigid support provides a substantially inflexible substrate for a microfluidic die. In one embodiment, a packaged sensor including a sensor and an ASIC is mounted on the rigid support. In another embodiment, the sensor and the ASIC is coupled directly to the rigid support.

BRIEF DESCRIPTION OF THE SEVERAL VIEWS OF THE DRAWINGS

In the drawings, identical reference numbers identify similar elements. The sizes and relative positions of elements in the drawings are not necessarily drawn to scale.

DETAILED DESCRIPTION

Figure 1:
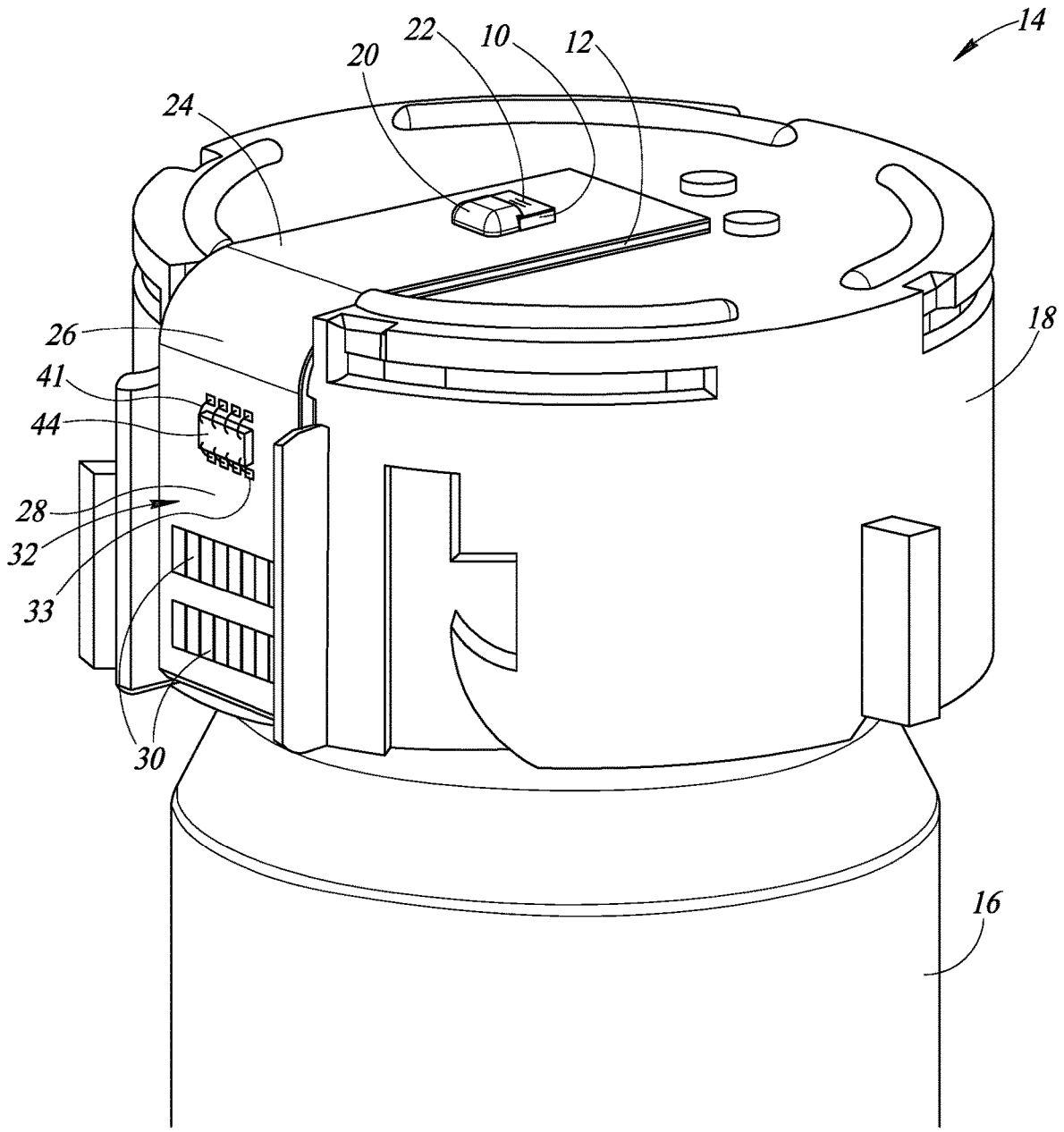
FIG. 1 is a perspective view of a semi-flexible support coupled to a cartridge of a fluid distribution system according to one embodiment disclosed herein.

In the following description, certain specific details are set forth in order to provide a thorough understanding of various embodiments of the disclosure. However, one skilled in the art will understand that the disclosure may be practiced without these specific details. In some instances, well-known details associated with semiconductors, integrated circuits, and microfluidic delivery systems have not been described to avoid obscuring the descriptions of the embodiments of the present disclosure.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

In the drawings, identical reference numbers identify similar features or elements. The size and relative positions of features in the drawings are not necessarily drawn to scale.

FIG. 1 is a perspective view of a semi-flexible support 12 coupled to a cartridge 14 of a fluid distribution system according to one embodiment. A microfluidic die 10 and another die 44 are positioned on the semi-flexible support 12. The die 44 may be a processor, an application specific integrated circuit (ASIC), or a sensor. If the die is a processor or an ASIC, the die may be included to control drive signals of the microfluidic die 10. Contacts 30 may provide power and control signals to the die 44 and the microfluidic die 10.

The die 44 may also be a sensor that can detect environmental conditions relevant to the ejection of fluid by the microfluidic die, such as in a greenhouse environment. For example, if the sensor is a humidity sensor, the sensor can detect with the environment in the greenhouse is lower humidity than a threshold humidity and provide a control signal to the microfluidic die to eject water into the greenhouse. The die 44 may send a signal to a remote processor through the contacts 30 or could send the signal directly to the microfluidic die. The remote processor may be used if there are several different sensors in the environment from which a variety of signals are collected and evaluated before a control signal is provided to the microfluidic die, through the contacts 30.

The semi-flexible support 12 includes a first rigid portion 24, a flexible portion 26, and a second rigid portion 28. The first rigid portion 24 is separated from the second rigid portion 28 by the flexible portion 26. The first rigid portion 24 is positioned on a top of a cap 18 of the cartridge 14, and the flexible portion 26 is curved over an edge of the cap 18. The second rigid portion 28 is positioned on a sidewall of the cap 18, which is substantially perpendicular to the top of the cap 18. The semi-flexible support 12 further includes the electrical contacts 30 on the second rigid portion 28. The electrical contacts 30 and the semi-flexible support 12 will be discussed in further detail with respect to FIGS. 2A to 2D.

In one embodiment, as shown in FIG. 1, the microfluidic die 10 is positioned on the first rigid portion 24 of the semi-flexible support 12, which overlies the top of the cap 18, and the die 44 and the electrical contacts 30 are positioned on the second rigid portion 28, which is on the sidewall of the cap 18. Accordingly, the semi-flexible support 12 allows the microfluidic die 10 to be at a different physical location from the die 44 and the electrical contacts 30. As will be discussed in further detail below, the microfluidic die 10 is positioned over a fluid opening 40.

It should be noted that although the die 44 and the electrical contacts 30 are illustrated at approximately a 90-degree angle with respect to the top of the cap 18, other angles are achievable depending on a design of the cap 18.

The cartridge 14 includes a reservoir 16 and the cap 18. The reservoir 16 stores fluid to be dispensed by the microfluidic die 10. The reservoir 16 may store any type of fluid, such as ink, water, fragrance oil, nutrients, and pesticides. The cap 18 encloses the reservoir 16. The reservoir 16 may be screwed in or snapped in to the cap 18. The cap 18 helps move liquid from the reservoir 16 to the microfluidic die 10 through an opening in the cap (not shown).

The microfluidic die 10 is configured to eject fluid from the reservoir 16 to an environment external to the fluid distribution system. The microfluidic die 10 includes nozzles 22; internal chambers; and other fluid elements, such as heaters or piezoelectric elements, that are configured to be driven by signals from the electrical contacts 30 to eject fluid from the internal chambers through the nozzles 22. The microfluidic die 14 may include any number of nozzles 22, and the nozzles 22 may have any arrangement. The microfluidic die 14 may dispense any type of fluid, such as ink, water, fragrance oil, nutrients, and pesticides.

An encapsulant 20 covers and protects conductive wires coupled to the microfluidic die 10, while leaving the nozzles 22 exposed. Each of the nozzles 22 provides a fluid path to eject fluid from internal chambers of the microfluidic die 10 to an environment external to the fluid distribution system. The microfluidic die 10 may include any number of nozzles 22, and the nozzles 22 may have any type of arrangement.

Although not shown, the microfluidic die 10 also includes a plurality of electrical traces on the microfluidic die 10 that are coupled to the conductive wires to receive signals to drive the ejection of fluid. The drive signals may be provided from another die, such as the die 44 or an external processor that send the drive signals through the electrical contacts 30.

The die 44 is shown as a packaged die with wires 41 that couple to contacts 33 on a first side 32 of the support. These wires may be exposed or may be covered by encapsulant. As noted above, the die 44 may be any type of die, including, but not limited to, a MEMS device and a sensor, such as a temperature, humidity, pressure, and light sensor.

By positioning the microfluidic die 10 and the die 44 on the semi-flexible support 12, the microfluidic die 10 and the die 44 may share the same electrical interconnect system. For example, as will be discussed in further detail below, the microfluidic die 10 and the die 44 may both be electrically coupled to electrical contacts 30. In addition, the microfluidic die 10 and the die 44 may be positioned in close proximity to each other. This is ideal for sensors that need to be in close proximity to the microfluidic die 10 to obtain useful and accurate measurements. Further, integrating the die 44 on the same support as a microfluidic die 10 allows the die 44 and the microfluidic die 10 to be replaced concurrently, thus reducing intervention rate and presumably maintenance costs. This is well suited for die that have finite life, such as sensors containing a chemical reactive.

Figure 2A:
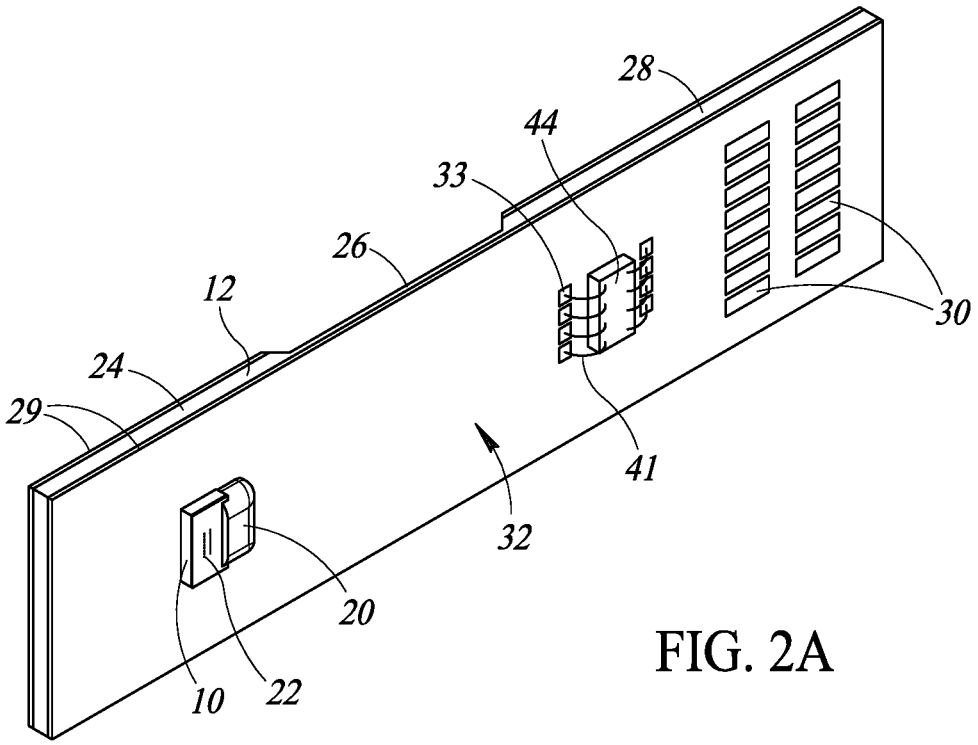
FIG. 2A to 2C are additional views of the semi-flexible support of FIG. 1.
Figure 2B:
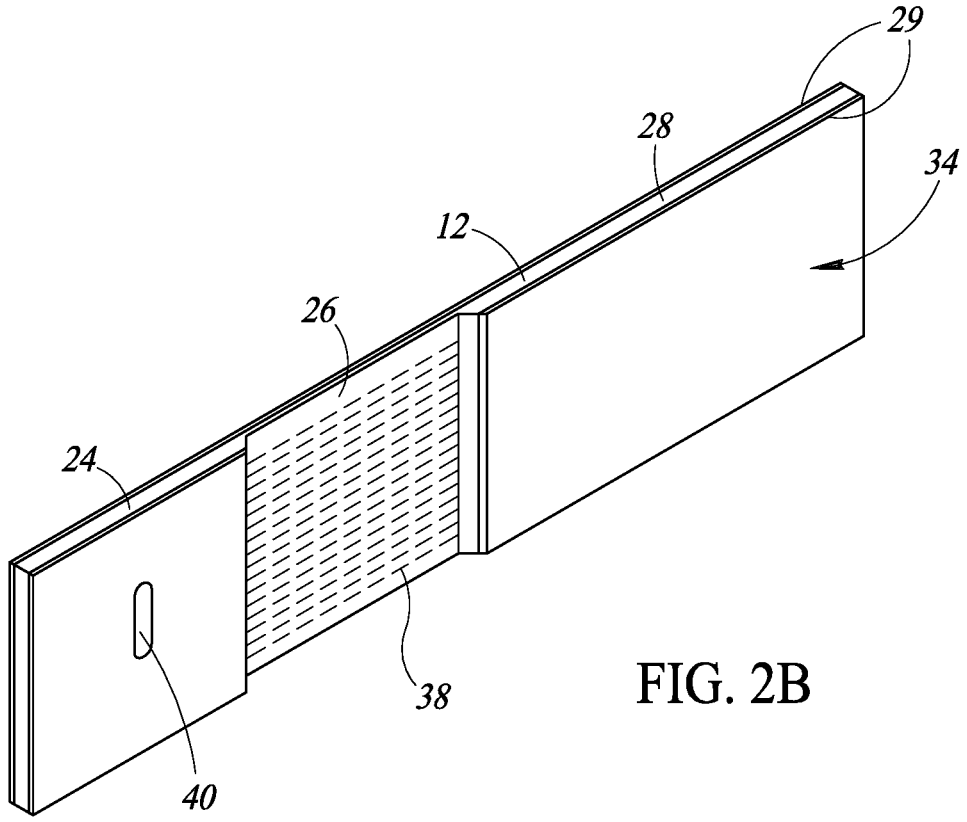
Figure 2C:
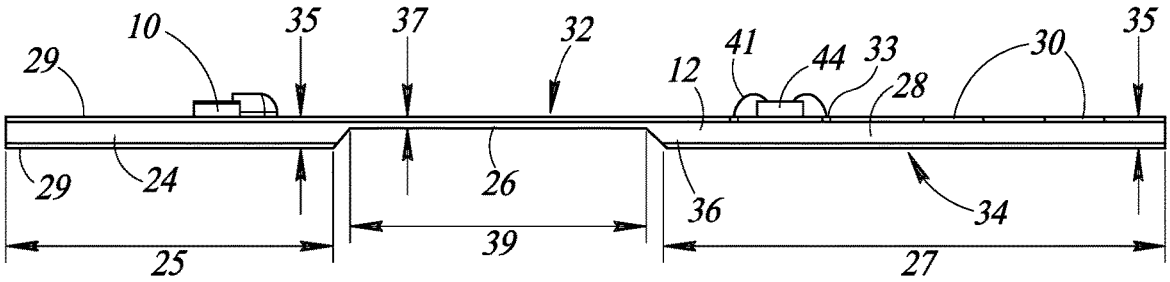

FIGS. 2A to 2C are additional views of the semi-flexible support 12. FIG. 2A is a perspective view of a first side 32 of the semi-flexible support 12. FIG. 2B is a perspective view of a second side 34 of the semi-flexible support 12. FIG. 2C is a side view of a third side 36 of the semi-flexible support 12. It is beneficial to review FIGS. 2A, 2B, and 2C together. The semi-flexible support 12 includes the electrical contacts 30, conductive wires 38, and a fluid opening 40. As previously discussed, the microfluidic die 10 is positioned on the first rigid portion 24 and the die 44 and the electrical contacts 30 are positioned on the second rigid portion 28.

The first rigid portion 24 has a width 25 and the second rigid portion 28 has a width 27. The widths 25 and 27 may be adjusted based on a size and shape of a cap or other object on to which the semi-flexible support 12 will be placed. For example, as shown in FIG. 1, the widths of the first rigid portion 24 and the second rigid portion 28 may be adjusted to position the microfluidic die 10 near a center of a top of the cap 18 and position the die 44 and the electrical contacts 30 on a side of the cap 18. The widths 25 and 27 may also be adjusted based on the components that need to be accommodated. For example, as shown in FIG. 2C, the width 25 may be adjusted to accommodate the microfluidic die 10, and the width 27 may be adjusted to be larger than the width 25 to accommodate both the die 44 and the electrical contacts 30.

The electrical contacts 30 are electrically coupled to the microfluidic die 10 and the die 44. The electrical contracts 30 allow external devices to be electrically coupled to the microfluidic die 10 and the die 44. The electrical contacts 30 may be electrically coupled to the microfluidic die 10 and the die 44 through any number of standard wire bond type connections. The semi-flexible support 12 may include any number of electrical contacts and may have any type of arrangement. In one embodiment, as shown in FIG. 2A, the semi-flexible support 12 includes at least two rows of electrical contacts 30 on the second rigid portion 28. In another embodiment, the semi-flexible support 12 includes electrical contacts 30 on both the first rigid portion 24 and the second rigid portion 28.

The electrical contacts 30 are electrically coupled to the microfluidic die 10 by the conductive wires 38. As best shown in FIG. 2B, the conductive wires 38 are embedded within the semi-flexible support 12 to allow a portion of the semi-flexible support 12 to be removed. As will be discussed in further detail below, a portion of the semi-flexible support 12 is removed to fabricate the flexible portion 26.

The fluid opening 40 extends through the first rigid portion 24 and underlies the microfluidic die 10. The fluid opening 40 provides a fluid path through the semi-flexible support 12 such that fluid may flow from the reservoir 16, through the cap 18 and the fluid opening 40, and to the microfluidic die 10.

In the same or another embodiment, the semi-flexible support 12 further includes protective layers 29. The protective layers 29 are configured to protect the semi-flexible support 12 from any external damage. The protective layers 29 may be formed on the first side 32, the second side 34, or both the first side 32 and the second side 34 of the semi-flexible support 12. In another embodiment, the semi-flexible support 12 is fabricated without the protective layers 29. The protective layers 29 may be made of silicon dioxide or any other suitable dielectric. The protective layers 29 may be solder masks.

The semi-flexible support 12 may be made of any type material that provides a rigid substrate. For example, the semi-flexible support 12 may be made of glass, silicon, or a printed circuit board (PCB), such as a FR4 PCB.

The flexible portion 26 of the semi-flexible support 12 may be fabricated by milling or thinning a specific portion of the semi-flexible support 12. Namely, as best shown in FIG. 2C, a portion of the semi-flexible support 40 is removed such that the first rigid portion 24 and the second rigid portion 28 each has a thickness 35 and the flexible portion 26 has a thickness 37 that is smaller than the thickness 35. By thinning the flexible portion 26, the semi-flexible support 12 may be bent up to and beyond 90 degrees. The central flexible portion 26 also has a width 39 that may be adjusted based on a size and shape of the cap or other object on to which the flexible support will be placed. For example, as shown in FIG. 1, the width 39 may be adjusted to allow the microfluidic die 10 and the die 44 to be on two different physical planes.

Figure 3A:
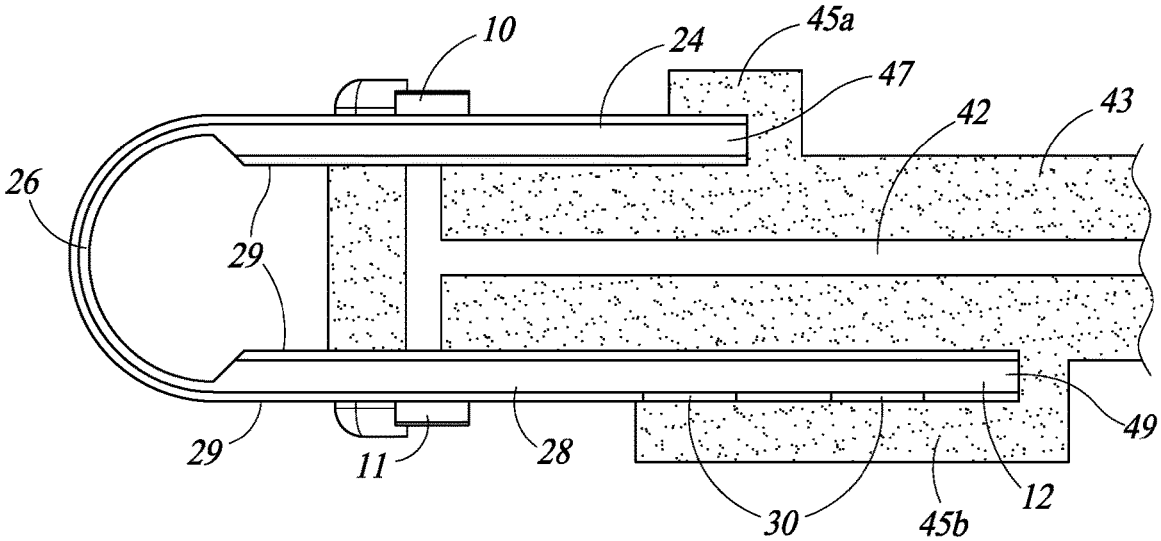
FIG. 3A is a side view of the semi-flexible support of FIGS. 2A to 2C having multiple microfluidic die.
Figure 3B:
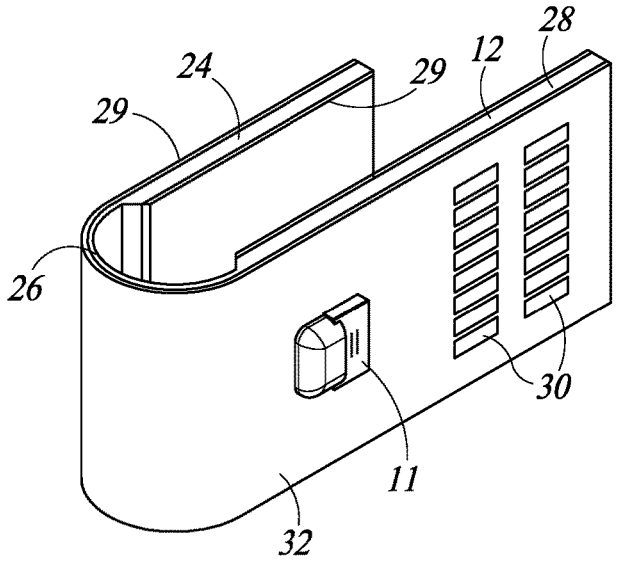
FIG. 3B is a perspective view of the semi-flexible support of FIG. 3A in a flexed position.

FIG. 3A is a side view of the semi-flexible support 12 when the die 44 is another microfluidic die 11, so the support includes a first microfluidic die 10 and a second microfluidic die 11. FIG. 3B is a perspective view of the semi-flexible support 12 shown in FIG. 3A in a flexed position. It is beneficial to review FIGS. 3A and 3B together.

In the embodiment shown in FIGS. 3A and 3B, fluid may be simultaneously ejected in multiple directions. Namely, the first microfluidic die 10 positioned on the first rigid portion 24 may eject fluid in a first direction and the second microfluidic die 11 positioned on the second rigid portion 28 may eject fluid in a second direction that is opposite to the first direction. The semi-flexible support 12 may be flexed in a variety of other positions, and thus eject fluid in a variety of different directions.

In one embodiment, the semi-flexible support 12 is flexed around a fluid line 42 of a fluid distribution system 43. The fluid line 42 is configured to simultaneously provide fluid to both of the microfluidic die 10, 11. The fluid distribution system includes arms or brackets 45*a*, 45*b* that hold a first end 47 and a second end 49 of the semi-flexible support 12 in place. These brackets ensure that the fluid line 42 lines up with and is in fluid communication with the microfluidic die 10, 11. The bracket 45*b* overlaps the electrical contacts 30 and electrical components (not shown) to transmit or receive signals from the contacts 30 to and from a processor or ASIC associated with the fluid distribution system. These brackets 45*a*, 45*b*, allow the support to be removed and replaced if needed, such as if the die have a limited life, i.e. the nozzles get clogged after a period of time of use.

Figure 4:
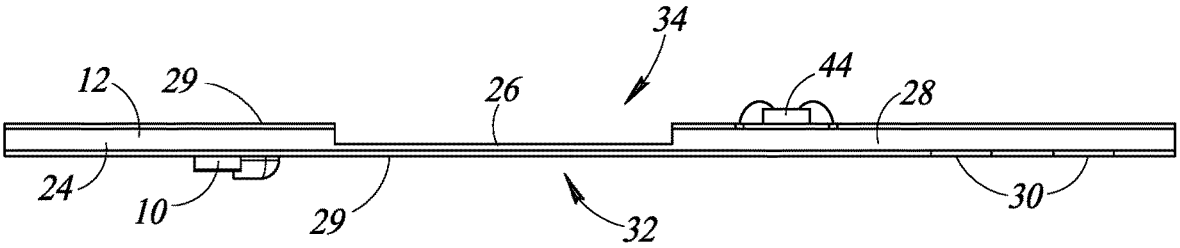
FIG. 4 is a side view of a semi-flexible support having a microfluidic die and a die positioned on opposite sides of the semi-flexible support according to one embodiment disclosed herein.

FIG. 4 is a side view of the semi-flexible support 12 when the microfluidic die 10 is positioned on the first side 32 of the semi-flexible support 12 and the die 44 positioned on the opposite, second side 34 of the semi-flexible support 12. By positioning the die 44 on the opposite side of the semi-flexible support 12 from the microfluidic die 10, the die 44 may be protected from fluid being ejected from the microfluidic die 10. In another embodiment, the die 44 of FIG. 4 is replaced with another microfluidic die 10. Accordingly, in this embodiment, fluid may be ejected in opposite directions without bending the semi-flexible support 12.

Figure 5A:
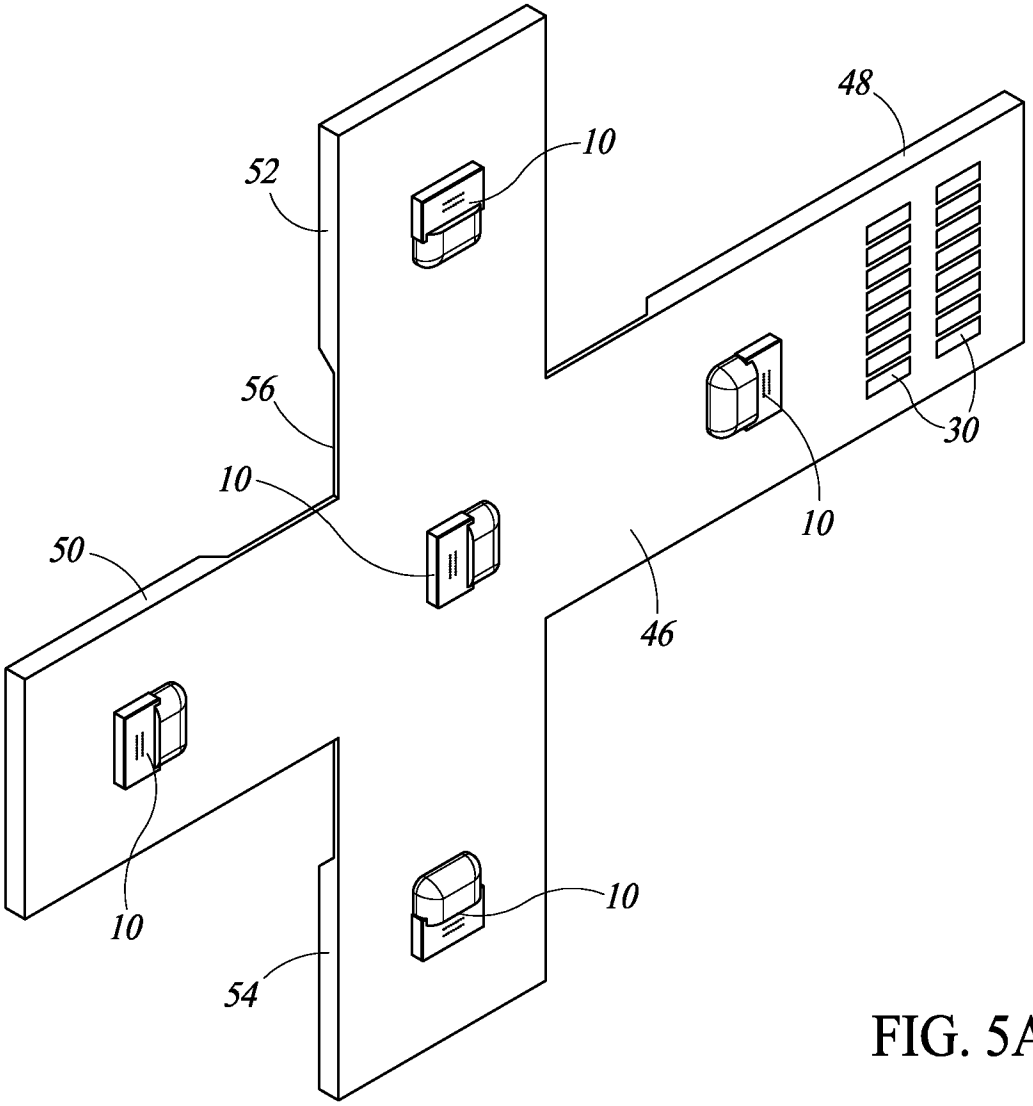
FIG. 5A is a perspective view of a semi-flexible support according to another embodiment disclosed herein.
Figure 5B:
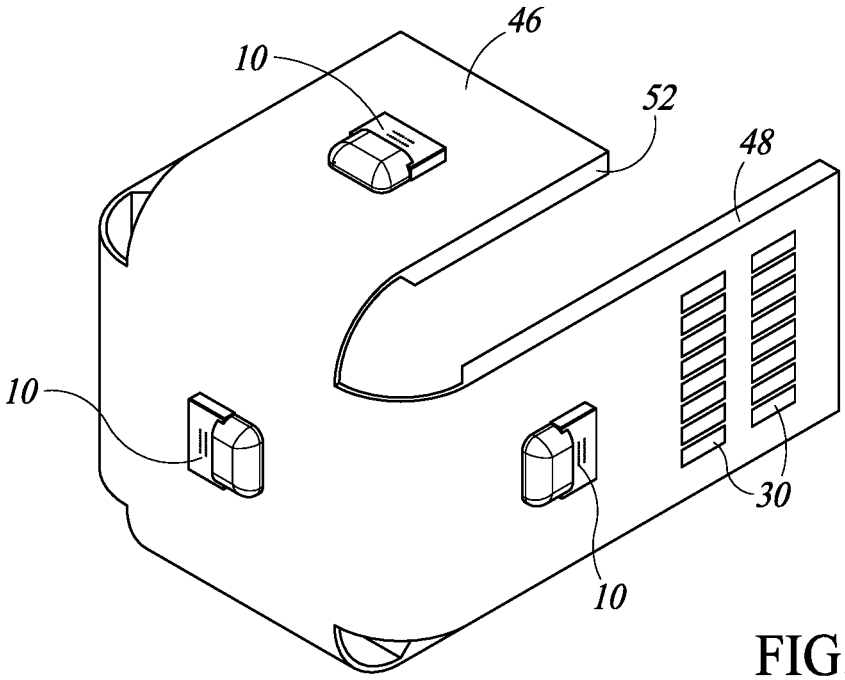
FIG. 5B is a perspective view of the semi-flexible support of FIG. 5A in a flexed position.

FIG. 5A is a perspective view of a semi-flexible support 46 according to another embodiment. FIG. 5B is a perspective view of the semi-flexible support 46 in a flexed position. It is beneficial to review FIGS. 5A and 5B together.

In contrast to the semi-flexible support 12, the semi-flexible support 46 is cross or "t" shaped. In particular, the semi-flexible support 46 includes a first rigid portion 48, a second rigid portion 50, a third rigid portion 52, a fourth rigid portion 54, and a flexible portion 56, these can be thought of as arms or branches from a central flexible portion 56. The first, second, third, and fourth rigid portions 48, 50, 52, and 54 are separated from each other by the flexible portion 56. As best shown in FIG. 5A, the first and second rigid portions 48 and 50 are aligned in a first direction, and the third and fourth rigid portions 52 and 54 are aligned in a second direction that is substantially perpendicular to the first direction. The semi-flexible support 46 may be made of any type material that provides a rigid substrate. For example, the semi-flexible support 46 may be made of glass, silicon, or a printed circuit board (PCB), such as a FR4 PCB.

In one embodiment, as shown in FIGS. 5A and 5B, a microfluidic die 10 is positioned on each of the first, second, third, and fourth rigid portions 48, 50, 52, and 54 and the flexible portion 56. Although not shown, in FIGS. 5A and 5B, the semi-flexible support 46 includes fluid openings, similar to the fluid openings 40, extending through each of the first, second, third, and fourth rigid portions 48, 50, 52, and 54 to provide a fluid path through the semi-flexible support 46. A microfluidic die 10 is positioned over each of the fluid openings. In the another embodiment, one or more of the microfluidic die 10 shown in FIGS. 5A and 5B are replaced with another type of die, such as an ASIC, a MEMS device, and a sensor.

The electrical contacts 30 are positioned on the first rigid portion 48. As previously discussed, the electrical contacts 30 are electrically coupled to the microfluidic die 10 by conductive wires embedded within the semi-flexible support 46. As previously discussed with respect to the conduct wires 38, the conductive wires are embedded with the semi-flexible support 46 to allow a portion of the semi-flexible support 40 to be removed to fabricate the flexible portion 56.

The flexible portion 56, similar to the flexible portion 26, is fabricated by milling or thinning a specific portion of the semi-flexible support 46 such that the first, second, third, and fourth rigid portions 48, 50, 52, and 54 each has a thickness that is greater than the flexible portion 56. By thinning the flexible portion 56, the semi-flexible support 46 may have up to four different bends up to and beyond 90 degrees. For example, as shown in FIG. 5B, the semi-flexible support 46 may have four discrete bends to create a cup shape. Namely, the semi-flexible support 46 may be bent such that a surface of the first rigid portion 48 faces a surface of the second rigid portion 50, and a surface of the third rigid portion 52 faces a surface of the fourth rigid portion 54. Accordingly, the semi-flexible support 46 allows the microfluidic die 10 to radially eject fluid up to five different directions.

The semi-flexible support 46 may be flexed in a variety of positions, and thus eject fluid in a variety of different directions. For example, the semi-flexible support 36 may have a single bend, two bends, or three bends to create any number of increasingly complex shapes.

The semi-flexible support 46 may also have other shapes. For example, in one embodiment, the semi-flexible support 46 is composed of twelve five-sided pentagons of equal size and eleven bends to create a pentagon ball. One or more microfluidic die may then be placed on any of the exterior surfaces of the pentagon ball to eject fluid outwards in all directions.

Figure 6A:
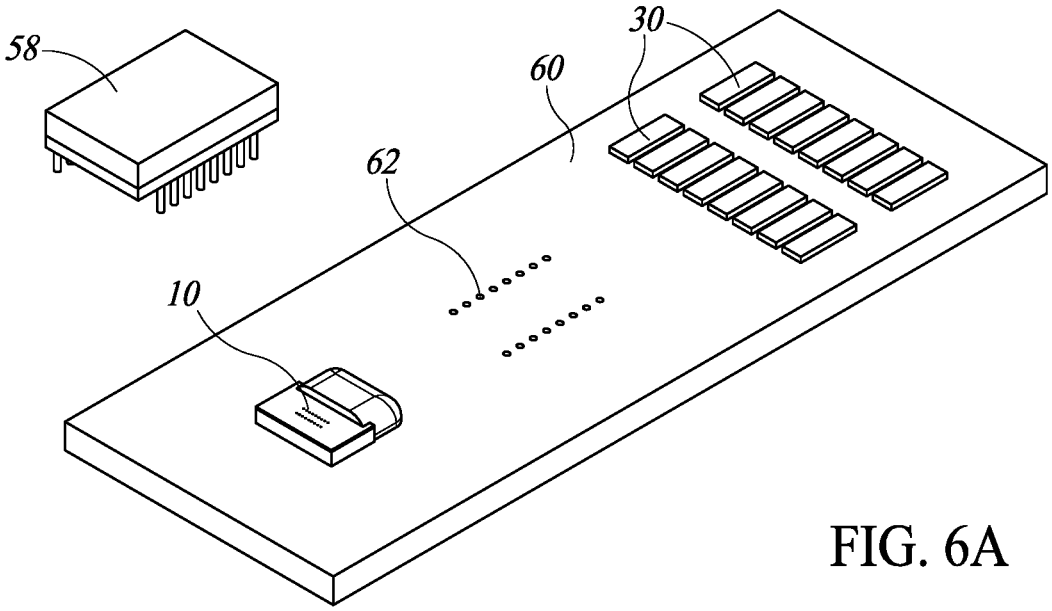
FIG. 6A is a perspective view of a packaged sensor being coupled to a rigid support according to one embodiment disclosed herein.
Figure 6B:
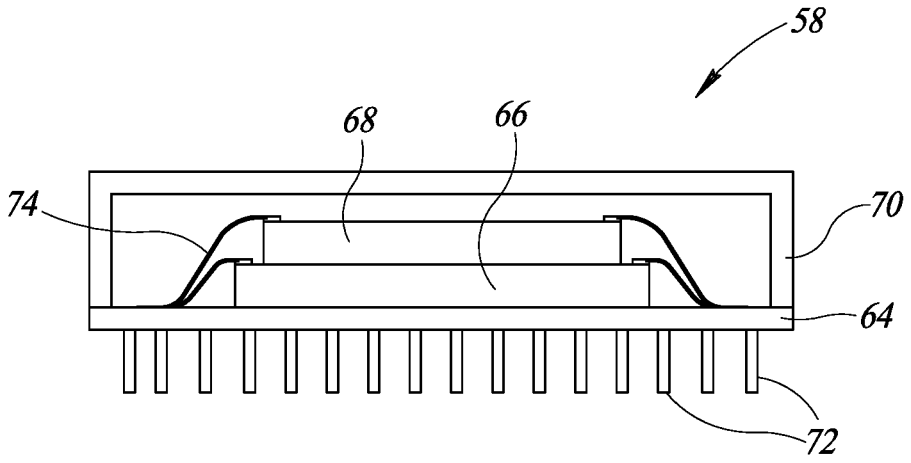
FIG. 6B is a cross-sectional view of the packaged sensor of FIG. 6A.

FIG. 6A is a perspective view of a packaged sensor 58 being coupled to a rigid support 60 according to one embodiment. FIG. 6B is a cross-sectional view of the packaged sensor 58. It is beneficial to review FIGS. 6A and 6B together.

The rigid support 60 provides a substantially inflexible substrate for a microfluidic die 10. Similar to the semi-flexible supports 12 and 46, the microfluidic die 10 is positioned over a fluid opening extending through the rigid support 60 to provide a fluid path through the rigid support 60. For example, see the fluid opening 40 shown in FIG. 7A.

The rigid support 60 may be made of any type material that provides a rigid substrate. For example, the rigid support 60 may be made of glass, silicon, or a printed circuit board (PCB), such as a FR4 PCB.

The rigid support 60 includes electrical contacts 30 and through holes 62. As previously discussed, the electrical contacts 30 are electrically coupled to the microfluidic die 10 and allow external devices to be electrically coupled to the microfluidic die 10. The through holes 62 are configured to receive a through hole mount connector 64, which will be discussed in further detail below.

The packaged sensor 58 includes a through hole mount connector 64, a sensor 66, an ASIC 68, and a cover 70.

The through hole mount connector 64 couples the packaged sensor 58 to the rigid support 60 by inserting leads 72 of the through hole mount connector 64 into the through holes 62. It should be noted that other methods may be used to couple the packaged sensor 58 to the rigid support 60. For example, in another embodiment, the through hole mount connector 60 is replaced with a ball grid array (BGA) mount.

The sensor 66 is positioned on the through hole mount connector 64. The sensor 66 may be any type of sensor, such as a temperature, humidity, pressure, and light sensor.

The ASIC 68 is positioned on the sensor 66. In another embodiment, the ASIC 68 is positioned on the through hole mount connector 64, lateral to the sensor 66. In one embodiment, the ASIC 68 is configured to control the microfluidic die 10 and the sensor 66.

The cover 70 is coupled to the through hole mount connector 64, covering the sensor 66 and the ASIC 68. The cover 70 provides protection for the sensor 66 and the ASIC 68 from external sources, such as fluid being ejected from the microfluidic die 10.

In one embodiment, the sensor 66 and the ASIC 68 are electrically coupled to the leads 72 by conductive wires 74. In the same or another embodiment, the microfluidic die 10, the electrical contacts 30, and the through holes 62 are electrically coupled to each other.

The microfluidic die 10, the packaged sensor 58, and the electrical contacts 30 may be positioned in multiple different configurations. For example, in one embodiment, as shown in FIG. 6A, the microfluidic die 10, the electrical contacts 30 and the through holes 62 are all positioned on the same surface of the rigid support 60. In another embodiment, the microfluidic die 10 and the electrical contacts 30 are positioned on a first surface of the rigid support 60 and the packaged sensor 58 is positioned on a second surface, opposite to the first surface, of the rigid support 60.

In another embodiment, the sensor 66 and the ASIC 68 are mounted directly to the rigid support 60, without the through hole mount connector 60. FIGS. 7A to 7D are perspective views illustrating subsequent steps for coupling the sensor 66, the ASIC 68, and the microfluidic die 10 directly to the rigid support 60 according to one embodiment.

Figure 7A:
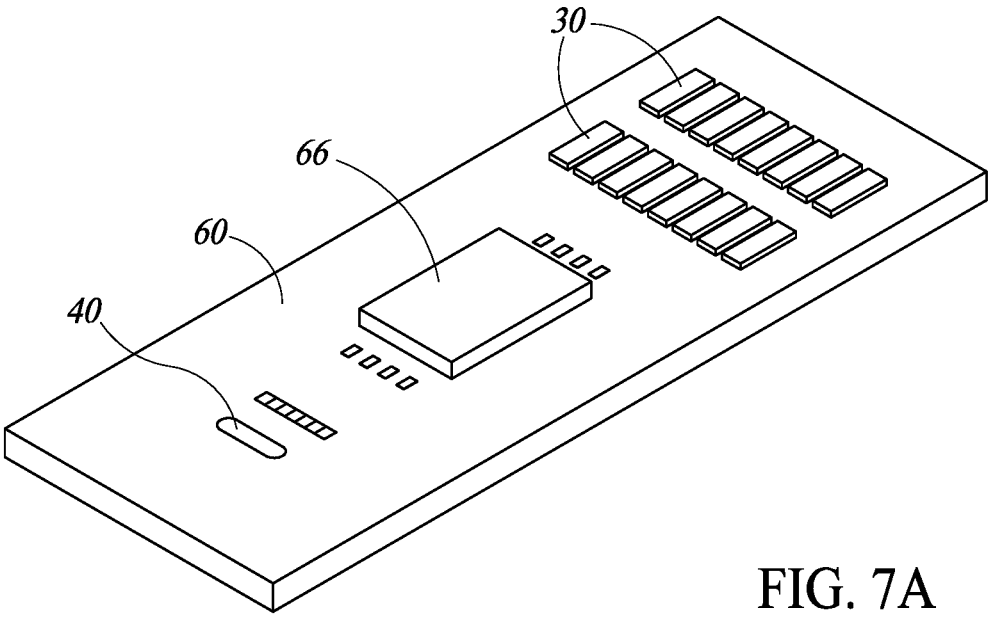
FIGS. 7A to 7D are perspective views illustrating subsequent steps for coupling a sensor, an ASIC, and a microfluidic die directly to a rigid support according to one embodiment disclosed herein.

At a step shown in FIG. 7A, the sensor 66 is positioned directly on the rigid support 60. The sensor 66 may be coupled to the rigid support 60 using processing techniques that are currently known or later developed.

Figure 7B:
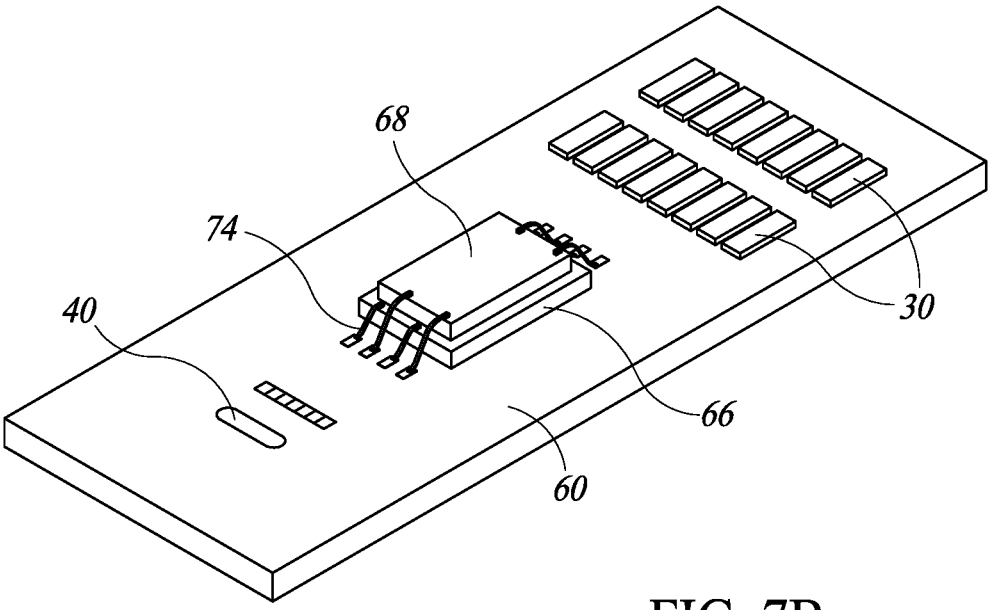

At a step shown in FIG. 7B, the ASIC 68 is positioned on the sensor 66. In another embodiment, the ASIC 68 is positioned directly on the rigid support 60, lateral to the sensor 66. The ASIC 68 may be coupled to the sensor 66 and the rigid support 60 using processing techniques that are currently known or later developed. For example, in one embodiment, the ASIC 68 is attached to the sensor 66 using epoxy. The sensor 66 and the ASIC 68 are then electrically coupled to contact pads on the rigid support 60 by conductive wires 74. Although only few conductive wires 74 are shown in FIG. 7B, the sensor 66 and the ASIC 68 may include any number of conductive wires 74.

Figure 7C:
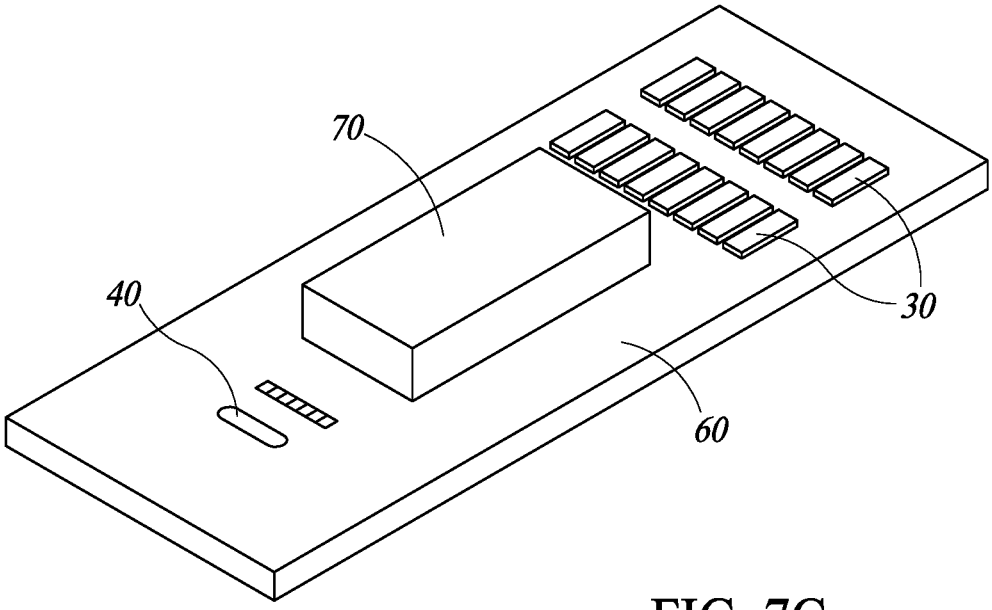

At a step shown in FIG. 7C, the cover 70 is coupled to the rigid support 60, covering the sensor 66 and the ASIC 68. The cover 70 may be coupled to the rigid support 60 using processing techniques that are currently known or later developed.

Figure 7D:
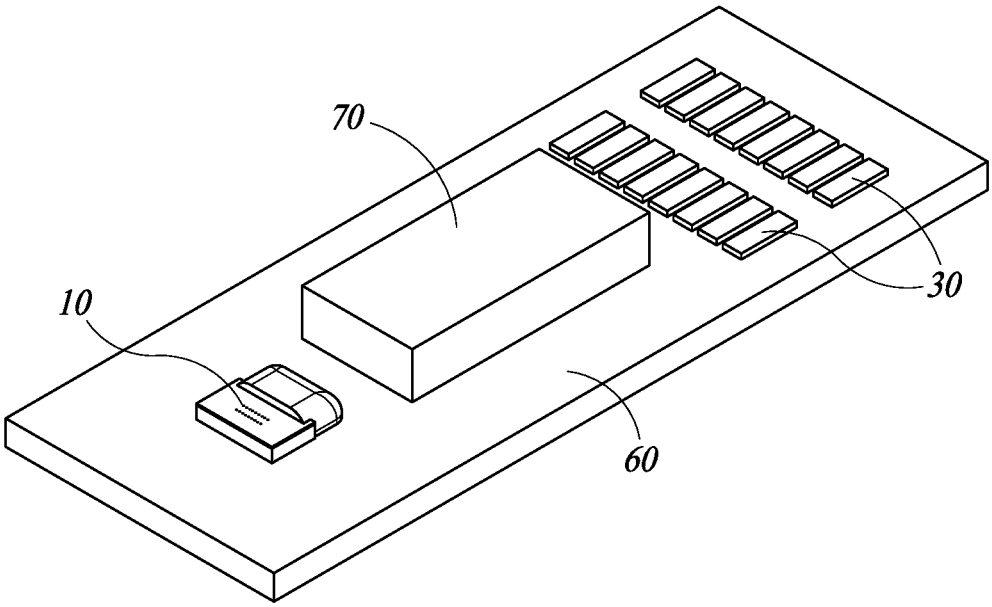

At a step shown in FIG. 7D, the microfluidic die 10 is coupled to the rigid support 60, overlying the fluid opening 40. The microfluidic die 10 may be coupled to the rigid support 60 using processing techniques that are currently known or later developed.

The microfluidic die 10, the sensor 66, the ASIC 68 may be coupled to the rigid support 60 in any order. In one embodiment, the microfluidic die 10 is coupled to the rigid support 60 prior to the sensor 66 and the ASIC 68. In another embodiment, the order of operating depends on the relative value of the components. For example, the components with the highest value may be coupled to the rigid support 60 last.

In accordance with one or more embodiments, the semi-flexible supports and the rigid supports provide a low cost solution to replace supports and flexible interconnects of traditional thermal inkjet systems. Each of the supports are configured to support a microfluidic die and one or more additional die including, but not limited to, microfluidic die, ASICs, MEMS devices, and sensors. In one or more embodiments, the supports are configured to support multiple microfluidic die to eject fluid in multiple different directions. In one or more embodiments, the supports are configured support a microfluidic die in close proximity to another die.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A microfluidic die support, comprising:
- a fluid line;
- a first surface and a second surface;
- a first opening extending through the first and second surfaces, the first opening being aligned with the fluid line;
- a second opening extending through the first and second surfaces, the second opening aligned with the fluid line;
- a plurality of contact pads on the first surface;
- a first microfluidic die on the first surface, the first microfluidic die is aligned with the first opening, the first microfluidic die is configured to be in fluid communication with the fluid line through the first opening; and
- a second microfluidic die on the first surface, the second microfluidic die is aligned with the second opening, the second microfluidic die is configured to be in fluid communication with the fluid line through the second opening.

2. The microfluidic die support of claim 1 wherein the first die being electrically coupled to the plurality of contact pads.

3. The microfluidic die support of claim 1 further comprising a first rigid portion, a second rigid portion, and a flexible portion that separates the first and second rigid portions from each other, the first die is on the first rigid portion, and the second die is on the second rigid portion.

4. The microfluidic die support of claim 3 wherein the flexible portion has a thickness that is smaller than a thickness of the first rigid portion and smaller than a thickness of the second rigid portion.

5. The microfluidic die support of claim 1 further comprising a first rigid portion, a second rigid portion, a third rigid portion, a fourth rigid portion, and a flexible portion that separates the first rigid portion, the second rigid portion, the third rigid portion, and the fourth rigid portion from each other.

6. The microfluidic die support of claim 5 wherein the first and second rigid portions are aligned along a first axis, and the third and fourth rigid portions are aligned along a second axis that is transverse to the first axis.

7. The microfluidic die support of claim 5 wherein the first die is on the first rigid portion, and the second die is on the second rigid portion, the system further including:
- a third die on the third rigid portion;
- a fourth die on the fourth rigid portion; and
- a fifth die on the flexible portion.

8. The microfluidic die support of claim 7 wherein the second, the third, the fourth, and the fifth die are microfluidic die.

9. A microfluidic die support, comprising:
- a first portion having a first thickness;
- a second portion having a second thickness;
- a third portion having a third thickness, the third thickness being less than the first thickness and less than the second thickness, the first portion being separated from the second portion by the third portion, and the third portion coupling the first portion to the second portion;
- a first opening in the first portion;
- a second opening in the second portion;
- a first die on the first portion and aligned with the first opening; and
- a second die on the second portion and aligned with the second opening.

10. The microfluidic die support of claim 9 further comprising contact pads on the second portion, the first die being electrically coupled to the contact pads.

11. The microfluidic die support of claim 9 wherein the first die and the second die are microfluidic die.

12. A microfluidic die support, comprising:
- a first surface and a second surface opposite the first surface;
- a first end and a second end opposite the first end;
- a rigid portion extending from the first end to the second end and extending from the first surface to the second surface;
- an opening extending through the first and the second surfaces and adjacent to the first end;
- electrical contacts on the first surface and adjacent to the second end of the rigid support;
- a first microfluidic die on the first surface and adjacent to the first end, the first microfluidic die aligned with the opening;
- a second die on the first surface; and
- a cover on the first surface and covering the second die.

13. The microfluidic die support of claim 12, further comprising a first package that includes the cover, the support further includes through holes, the first package being coupled to the through holes.

14. The microfluidic die support of claim 13 wherein the first package further includes:
- a through hole mount connector coupled to the through holes; and
- a third die on the second die.

15. The microfluidic die support of claim 14 further comprising:
- a first conductive wire coupling the second die to the through hole mount connector; and
- a second conductive wire coupling the third die to the through hole mount connector.

16. The microfluidic die support of claim 12 wherein the second die is between the first microfluidic die and the electrical contacts.

17. The microfluidic die support of claim 16 further comprising a third die on the second die.

18. The microfluidic die support of claim 17 wherein the cover is coupled to the support and covers the second die and the third die.

* * * * *